US008480358B2

(12) United States Patent
Frank et al.

(10) Patent No.: US 8,480,358 B2
(45) Date of Patent: Jul. 9, 2013

(54) VARIABLE NOZZLE FOR A TURBOCHARGER, HAVING NOZZLE RING LOCATED BY RADIAL MEMBERS

(75) Inventors: Daniel Frank, Charmes (FR); Baptiste Szczyrba, Meurthe et Moselle (FR); Claude Nivoit, Thaon les Vosges (FR); Dominique Colombier, Thaon les Vosges (FR)

(73) Assignee: Honeywell International Inc., Morristown, NJ (US)

( * ) Notice: Subject to any disclaimer, the term of this patent is extended or adjusted under 35 U.S.C. 154(b) by 363 days.

(21) Appl. No.: 12/746,814

(22) PCT Filed: Nov. 25, 2008

(86) PCT No.: PCT/US2008/084602

§ 371 (c)(1),
(2), (4) Date: Jun. 8, 2010

(87) PCT Pub. No.: WO2009/076062

PCT Pub. Date: Jun. 18, 2009

(65) Prior Publication Data

US 2011/0038715 A1 Feb. 17, 2011

Related U.S. Application Data

(60) Provisional application No. 61/013,008, filed on Dec. 12, 2007.

(51) Int. Cl.
*F01D 17/16* (2006.01)

(52) U.S. Cl.
USPC ..... 415/164; 415/166

(58) Field of Classification Search
USPC ..... 415/148, 155, 157, 158, 159, 160, 415/167, 166
See application file for complete search history.

(56) References Cited

U.S. PATENT DOCUMENTS

| | | | | |
|---|---|---|---|---|
| 7,406,826 | B2 * | 8/2008 | Hayashi et al. | 60/602 |
| 2005/0226718 | A1 * | 10/2005 | Marcis et al. | 415/163 |
| 2008/0075582 | A1 * | 3/2008 | Sausse et al. | 415/159 |
| 2008/0193281 | A1 * | 8/2008 | Sausse et al. | 415/158 |

FOREIGN PATENT DOCUMENTS

| | | | |
|---|---|---|---|
| EP | 1 734 231 | A1 | 12/2006 |
| WO | WO 2007/045798 | A1 | 4/2007 |

OTHER PUBLICATIONS

International Preliminary Report on Patentability for International Application No. PCT/US2008/084602 mailed Jun. 24, 2010.
Written Opinion for International Application No. PCT/US2008/084602 dated Jun. 12, 2010.

* cited by examiner

*Primary Examiner* — Edward Look
*Assistant Examiner* — William Vadala
(74) *Attorney, Agent, or Firm* — Alston & Bird LLP

(57) ABSTRACT

A variable nozzle for a turbocharger (10) has a nozzle ring (138) supporting an array of vanes (134) that are variable in setting angle. The nozzle ring (138) is rotationally oriented and fixed in position by a plurality of circumferentially spaced, radially outwardly extending locating members (170) that engage corresponding locating grooves (159) in a flange member (157) of the turbocharger.

4 Claims, 7 Drawing Sheets

VARIABLE NOZZLE FOR A TURBOCHARGER, HAVING NOZZLE RING LOCATED BY RADIAL MEMBERS

BACKGROUND OF THE INVENTION

The present disclosure relates to turbochargers having an array of variable vanes in the turbine nozzle for regulating exhaust gas flow into the turbine.

An exhaust gas-driven turbocharger is a device used in conjunction with an internal combustion engine for increasing the power output of the engine by compressing the air that is delivered to the engine's air intake to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is a center housing connected between the turbine and compressor housings for containing bearings for the shaft. The turbine housing defines a generally annular chamber that surrounds the turbine wheel and that receives exhaust gas from the engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

One of the challenges in boosting engine performance with a turbocharger is achieving a desired amount of engine power output throughout the entire operating range of the engine. It has been found that this objective is often not readily attainable with a fixed-geometry turbocharger, and hence variable-geometry turbochargers have been developed with the objective of providing a greater degree of control over the amount of boost provided by the turbocharger. One type of variable-geometry turbocharger is the variable-nozzle turbocharger (VNT), which includes an array of variable vanes in the turbine nozzle. The vanes are pivotally mounted in the nozzle and are connected to a mechanism that enables the setting angles of the vanes to be varied. Changing the setting angles of the vanes has the effect of changing the effective flow area in the turbine nozzle, and thus the flow of exhaust gas to the turbine wheel can be regulated by controlling the vane positions. In this manner, the power output of the turbine can be regulated, which allows engine power output to be controlled to a greater extent than is generally possible with a fixed-geometry turbocharger.

In one type of variable nozzle as noted above, the variable nozzle is provided in the form of a "cartridge" that is connected between the center housing and the turbine housing and comprises an assembly of a generally annular nozzle ring and an array of vanes circumferentially spaced about the nozzle ring and disposed in the nozzle such that exhaust gas flows between the vanes to the turbine wheel, each vane being rotatably mounted to the nozzle ring and connected to a rotatable actuator ring such that rotation of the actuator ring rotates the vanes for regulating exhaust gas flow to the turbine wheel. The cartridge includes an insert having a tubular portion sealingly received into the bore of the turbine housing and having a nozzle portion extending generally radially out from one end of the tubular portion, the nozzle portion being axially spaced from the nozzle ring such that the vanes extend between the nozzle ring and the nozzle portion. A plurality of spacers are connected between the nozzle portion of the insert and the nozzle ring for securing the nozzle ring to the insert and maintaining an axial spacing between the nozzle portion of the insert and the nozzle ring.

It is necessary to properly orient and fix the nozzle ring against movement relative to the insert and other fixed structure of the turbine. The present disclosure is concerned particularly with the proper orientation and fixing of the nozzle ring in the rotational sense about the turbine's rotational axis. Ideally the rotational fixing of the nozzle ring should not constrain thermal growth of the nozzle ring, and such growth should not unduly compromise the rotational fixing of the nozzle ring.

BRIEF SUMMARY OF THE DISCLOSURE

In accordance with one embodiment of the invention, a variable nozzle for a turbocharger comprises:

a generally annular nozzle ring supporting an array of vanes circumferentially spaced about a central axis of the nozzle ring, each vane being rotatably mounted to the nozzle ring such that the vane is pivotable about a pivot axis of the vane, the nozzle ring having a first side facing the vanes and an opposite second side, and having a radially outer edge surface extending between the first and second sides;

an insert having a tubular portion for being sealingly received into a bore of a turbine housing and having a nozzle portion extending generally radially out from one end of the tubular portion, a generally annular flange portion disposed radially outwardly of and axially spaced from the nozzle portion, a plurality of spacers extending between and connecting the nozzle portion of the insert and the nozzle ring, with the first side of the nozzle ring facing a first side of the nozzle portion of the insert;

a plurality of locating members affixed to the nozzle ring, each locating member extending in a generally radially outward direction beyond the radially outer edge surface of the nozzle ring, the locating members being circumferentially spaced apart from one another; and locating grooves formed in the flange portion of the insert and circumferentially spaced apart in correspondence with the circumferential spacing of the locating members, each locating groove extending in a generally radially outward direction, and the locating members being seated in the locating grooves so as to rotationally orient and fix the nozzle ring with respect to the insert.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
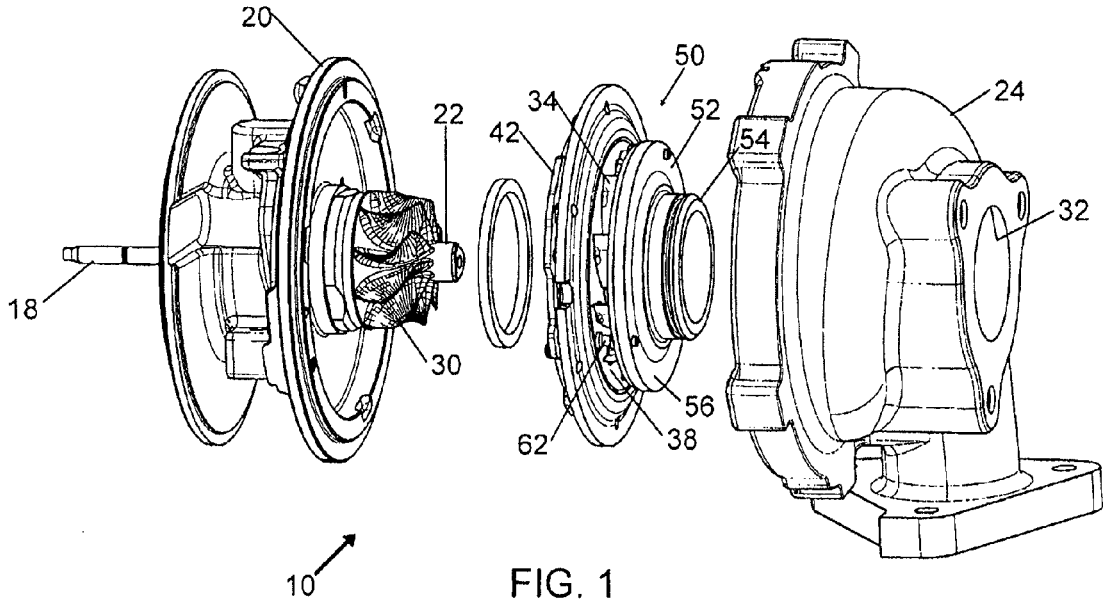
FIG. 1 is an exploded view of a turbine and center housing portion of a turbocharger.
Figure 2:
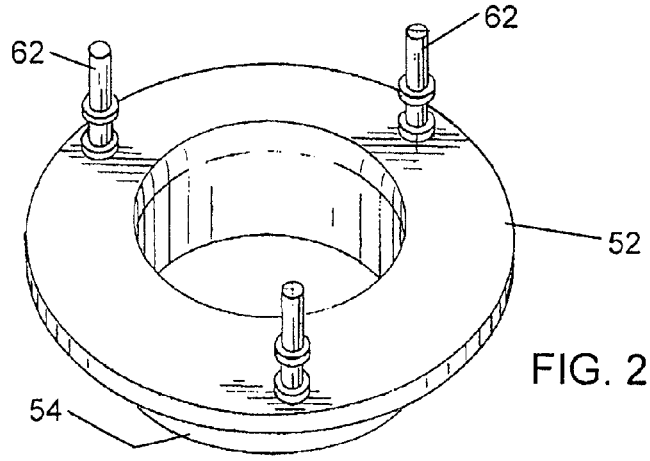
FIG. 2 is a perspective view of an insert of the turbocharger.

FIGS. 1 and 2 illustrate a turbine and center housing portion of a turbocharger 10 of the general type to which the present invention can be applied, although the features of the invention are not present in FIGS. 1 and 2. The turbocharger portion is employed in a turbocharger that comprises a compressor having a compressor wheel or impeller mounted on one end of a rotatable shaft 18 and disposed in a compressor housing (the compressor portion of the turbocharger is omitted for clarity and ease of illustration). The shaft is supported in bearings (not specifically illustrated) mounted in a center housing 20 of the turbocharger. The shaft 18 is rotated by a turbine wheel 22 mounted on the other end of the shaft 18 from the compressor wheel, thereby rotatably driving the compressor wheel, which compresses air drawn in through the compressor inlet and delivers the compressed air to the intake of an internal combustion engine (not shown) for boosting the performance of the engine.

The turbocharger also includes a turbine housing 24 that houses the turbine wheel 22. The turbine housing defines a generally annular chamber that surrounds the turbine wheel and that receives exhaust gas from the internal combustion engine for driving the turbine wheel. The exhaust gas is directed from the chamber generally radially inwardly through a turbine nozzle to the turbine wheel 22. As the exhaust gas flows through the passages between the blades 30 of the turbine wheel, the gas is expanded to a lower pressure, and the gas discharged from the wheel exits the turbine housing through a generally axial bore 32 therein.

The turbine nozzle is a variable nozzle for varying the cross-sectional flow area and flow direction through the nozzle so as to regulate flow into the turbine wheel. The nozzle includes a plurality of vanes 34 that are circumferentially spaced about the nozzle. Each vane is affixed to a shaft that passes through an aperture in a generally annular nozzle ring 38 that is mounted coaxially with respect to the turbine wheel 22. Each shaft is rotatable about its axis for rotating the attached vane. The nozzle ring 38 forms one wall of the flow passage of the nozzle. Each of the vane shafts has a vane arm affixed to an end of the shaft that protrudes out from the nozzle ring 38, and is engaged by a generally annular unison ring 42 (also referred to herein as an actuator ring) that is rotatable about its axis and that is coaxial with the nozzle ring 38. An actuator (not shown) is connected to the unison ring 42 for rotating it about its axis. When the unison ring is rotated, the vane arms are rotated to cause the shafts to rotate about their axes, thereby rotating the vanes 34 so as to vary the cross-sectional flow area and flow direction through the nozzle.

In the turbocharger 10, the variable vane mechanism is provided in the form of a cartridge 50 that is installable into and removable from the turbocharger as a unit. The cartridge 50 comprises the nozzle ring 38, vanes 34, shafts, vane arms, and unison ring 42. The cartridge further comprises an insert 52 (shown in isolated perspective view in FIG. 2) that has a tubular portion 54 sealingly received into a portion of the bore 32 of the turbine housing, and a nozzle portion 56 extending generally radially out from one end of the tubular portion 54, the nozzle portion 56 being axially spaced from the nozzle ring 38 such that the vanes 34 extend between the nozzle ring 38 and the nozzle portion 56. The bore portion of the turbine housing has a radius that exceeds that of the remainder of the bore 32. The radially outer surface of the tubular portion 54 has one or more axially spaced circumferential grooves, in each of which a sealing ring is retained for sealingly engaging the inner surface of the bore portion. Advantageously, the outer diameter of the tubular portion 54 of the insert is slightly less than the inner diameter of the bore portion so that a slight gap is defined therebetween, and hence the inner surface of the bore portion is contacted only the sealing ring(s). Additionally, there is a gap between the nozzle portion 56 and the adjacent end of the turbine housing at the end of the bore portion. In this manner, the insert 52 is mechanically and thermally decoupled from the turbine housing 24.

Figure 2A:
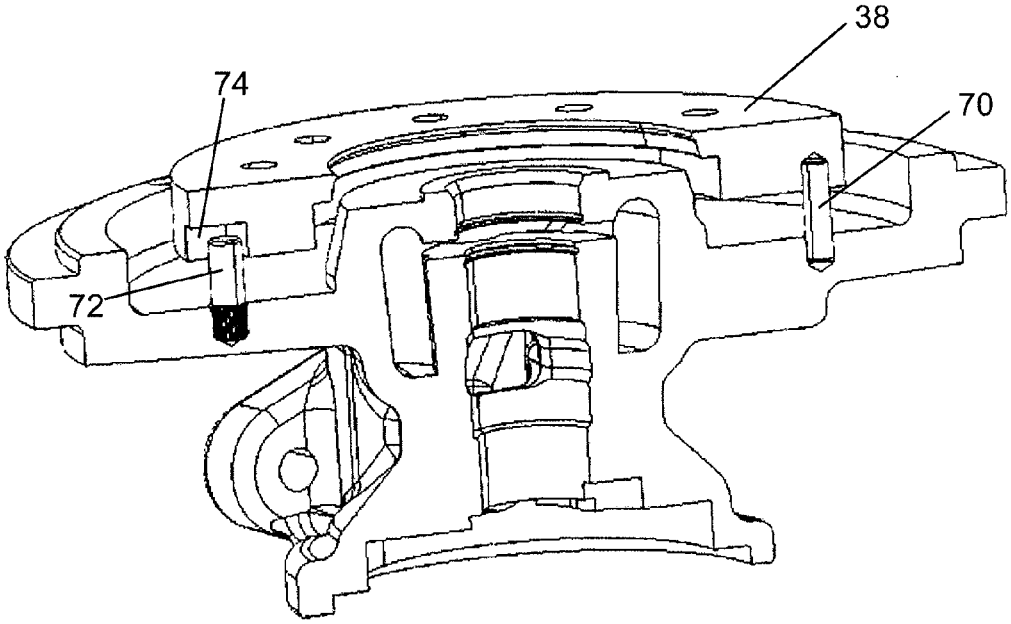
FIG. 2A is a perspective view, in section, of an assembly of a nozzle ring and center housing in accordance with an approach differing from the present invention.

A plurality of spacers 62 are connected between the nozzle ring 38 and the nozzle portion 56 of the insert 52 for securing the nozzle ring to the insert and maintaining the desired axial spacing between the nozzle ring 38 and the nozzle portion 56. As shown in FIG. 2A, one way that has been used for rotationally orienting and fixing the nozzle ring 38 is to employ two axially extending pins 70, 72 fixedly mounted in the center housing 20. A dowel pin 70 fits closely into a corresponding hole in the nozzle ring 38, and the second pin 72 located diametrically opposite the dowel pin fits into a radially elongated slot 74 in the nozzle ring. This arrangement allows the nozzle ring to thermally expand radially to some extent.

However, a problem with this arrangement is that the nozzle ring is substantially immovable at its connection to the dowel pin 70, such that thermal expansion occurs relative to this fixed point. As a result, the total radial displacement of the nozzle ring at locations diametrically opposite from the dowel pin are considerably larger than they would be if the geometric centerline of the nozzle ring were fixed and radial growth were relative to the centerline. This radially offset growth of the nozzle ring can lead to unacceptably large changes in vane setting angles. This can be a problem particularly with respect to the minimum flow setting of the turbine nozzle, which is set or calibrated during assembly of the turbocharger to comply with low-end performance objectives. Thermal displacement of the nozzle ring can be a significant factor contributing toward changing or "wandering" of the minimum flow from its desired value that is set during assembly.

Figure 3:
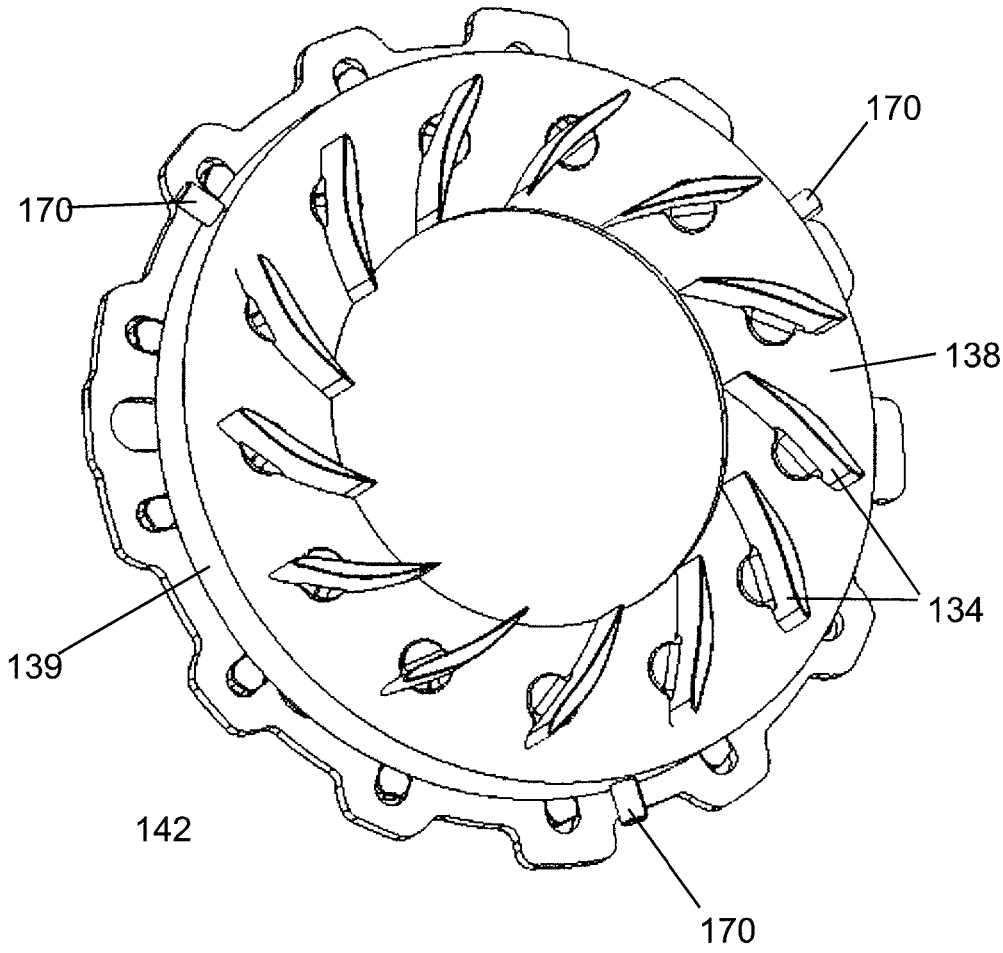
FIG. 3 is a perspective view of an assembly of a nozzle ring, vanes, and unison ring in accordance with one embodiment of the invention.

The present invention is concerned with improved ways of rotationally orienting and fixing the nozzle ring relative to the insert in order to reduce such wandering of the minimum flow value. One embodiment of the invention is illustrated in FIGS. 3 through 7. FIG. 3 shows an assembly of a nozzle ring 138 to which a plurality of vanes 134 are mounted, and a unison ring or actuator ring 142 that is coupled via crank arms 144 to the shafts of the vanes. The vanes 134 are adjacent a first side of the nozzle ring 138 and the unison ring 142 is adjacent an opposite second side of the nozzle ring. The nozzle ring has a radially outer edge surface 139. Three locating members 170, which for example can be pins as shown, are mounted in the nozzle ring and extend generally radially outwardly therefrom, radially beyond the outer edge surface 139 of the nozzle ring. The locating members 170 are circumferentially spaced apart from one another. Advantageously, the circumferential spacing is non-uniform; for example, two pairs of the members can be spaced apart by 115°, and the third pair can be spaced apart by 130°.

Figure 5:
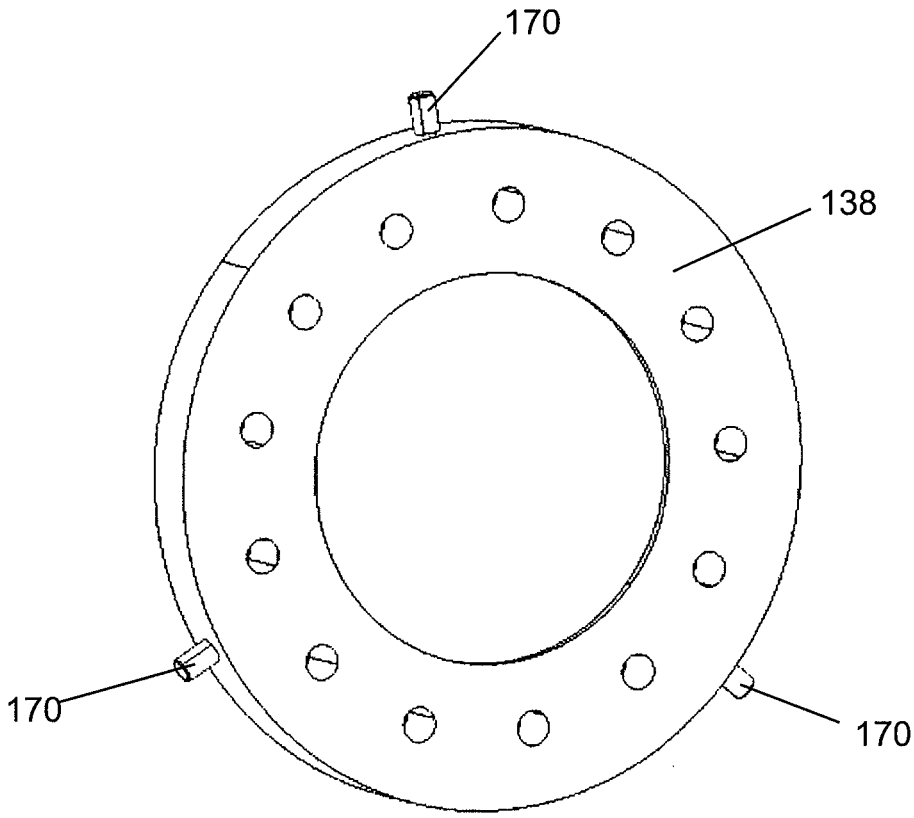
FIG. 5 is a perspective view of a nozzle ring having locating members in accordance with one embodiment of the invention.
Figure 6:
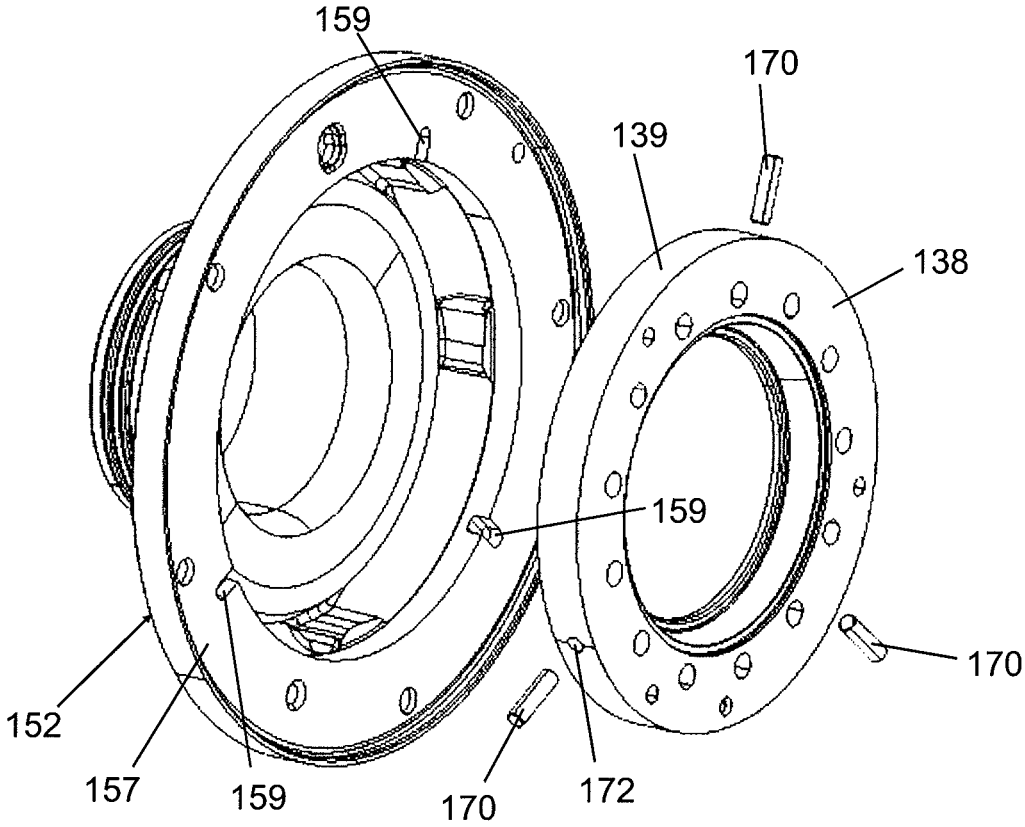
FIG. 6 is an exploded view of an assembly of the insert, nozzle ring, and locating members in accordance with one embodiment of the invention.

FIGS. 5 and 6 illustrate that the locating members 170 can comprise pins mounted in holes 172 (FIG. 6) drilled radially inwardly into the outer edge surface 139 of the nozzle ring.

Figure 4:
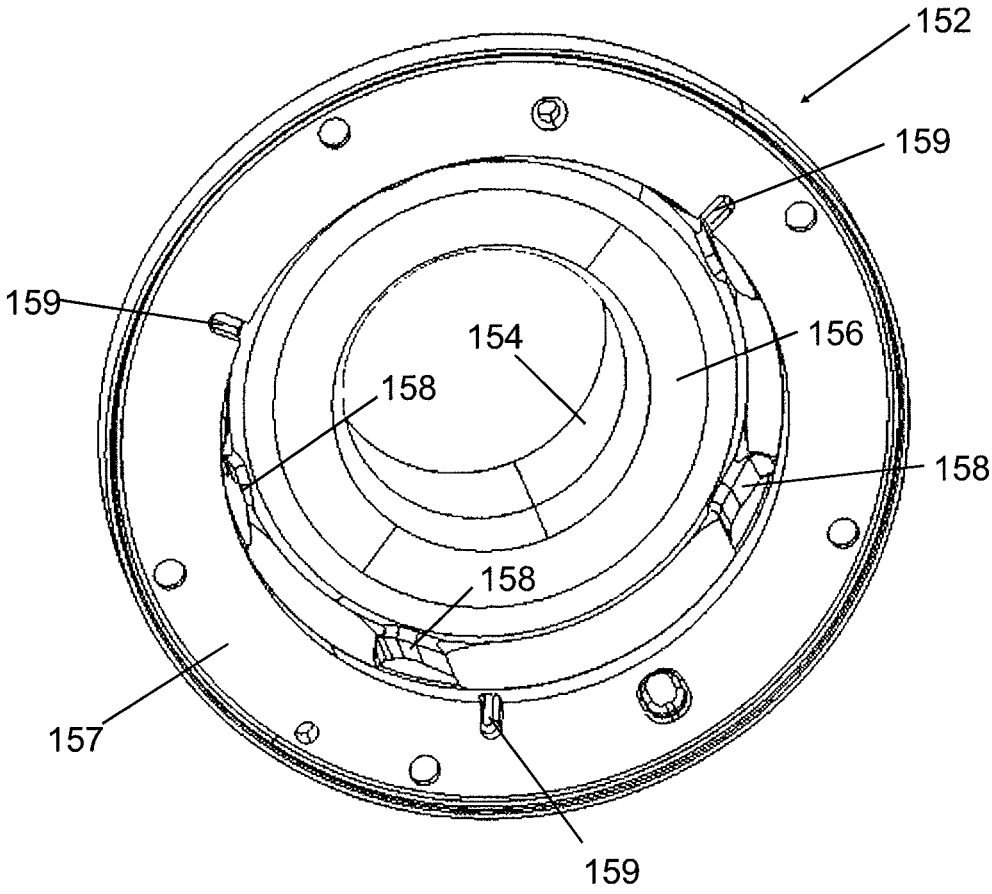
FIG. 4 is a perspective view of an insert in accordance with one embodiment of the invention.

FIG. 4 shows an insert 152 in accordance with one embodiment of the invention for use with the assembly of FIG. 3. The insert 152 has a tubular portion 154 that fits into the turbine housing bore, and a nozzle portion 156 that extends generally radially outwardly from one end of the tubular portion. The insert further includes a generally annular flange portion 157 that is radially outward of and axially spaced from the nozzle portion 156 in a direction toward the center housing of the turbocharger when the insert is installed in the turbocharger. The flange portion 157 is connected to the nozzle portion by several circumferentially spaced portions 158. Alternatively, the flange portion 157 can be wholly separate from the nozzle portion and tubular portion of the insert and can be mounted in the turbocharger by other means.

The flange portion defines three locating grooves 159 that are circumferentially spaced in the same manner as the locating members 170 on the nozzle ring. Thus, the preferred non-uniform spacing of the grooves and locating members ensures that the nozzle ring can be placed into engagement with the insert in only one (proper) orientation in which all three of the locating members 170 are seated in the locating grooves 159.

Figure 7:
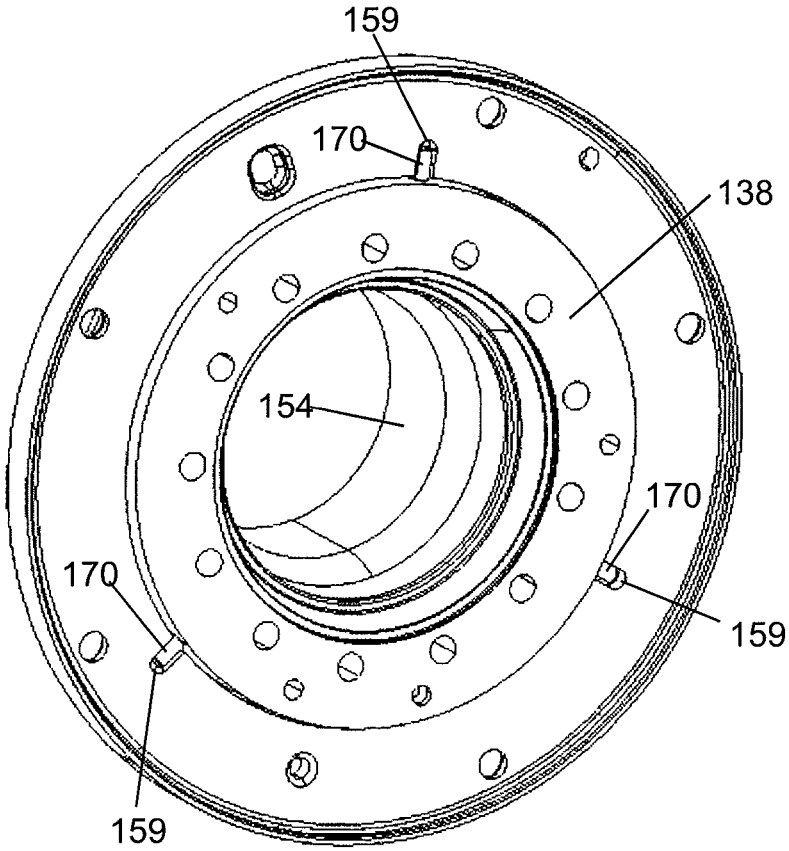
FIG. 7 is a perspective view of the assembly of FIG. 6 in an assembled condition.

This is illustrated in FIG. 7 in particular. The locating grooves 159 advantageously are sized such that there is relatively small "play" between the grooves and the locating members in the circumferential direction. The engagement of the locating members in the grooves thus orients and fixes the nozzle ring 138 with respect to the insert 152. In contrast, in the radial direction, the grooves 159 are longer than the locating members 170 so as to allow radial growth of the nozzle ring substantially without constraint by the insert.

The described arrangement allows for thermally induced growth of the nozzle ring to take place more uniformly relative to a more-fixed centerline of the nozzle ring, and thereby facilitates a significant reduction in changes in vane setting angles as a result of nozzle ring displacement. One particular advantage of the invention is that because the locating members 170 are located at a relatively large radial distance from the centerline, the impact of any displacement that occurs at the locating members on rotation of the nozzle ring is relatively small. Additionally, the locating members 170 and locating grooves 159 are readily visible to the person assembling the turbocharger, as opposed to the "blind" pins in the center housing and blind holes in the nozzle ring in the FIG. 2A arrangement. Thus, the invention aids in ease of assembly.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A variable nozzle for a turbocharger, comprising:

a generally annular nozzle ring supporting an array of vanes circumferentially spaced about a central axis of the nozzle ring, each vane being rotatably mounted to the nozzle ring such that the vane is pivotable about a pivot axis of the vane, the nozzle ring having a first side facing the vanes and an opposite second side, and having a radially outer edge surface extending between the first and second sides;

an insert having a tubular portion for being sealingly received into a bore of a turbine housing and having a nozzle portion extending generally radially out from one end of the tubular portion, a generally annular flange portion disposed radially outwardly of and axially spaced from the nozzle portion, a plurality of spacers extending between and connecting the nozzle portion of the insert and the nozzle ring, with the first side of the nozzle ring facing a first side of the nozzle portion of the insert;

a plurality of locating members affixed to the nozzle ring, each locating member extending in a generally radially outward direction beyond the radially outer edge surface of the nozzle ring, the locating members being circumferentially spaced apart from one another; and locating grooves formed in the flange portion of the insert and circumferentially spaced apart in correspondence with the circumferential spacing of the locating members, each locating groove extending in a generally radially outward direction, and the locating members being seated in the locating grooves so as to rotationally orient and fix the nozzle ring with respect to the insert.

2. The variable nozzle of claim 1, wherein the flange portion is connected to the nozzle portion by a plurality of circumferentially spaced portions.

3. The variable nozzle of claim 1, wherein the locating members comprise locating pins mounted in holes formed in the radially outer edge surface of the nozzle ring.

4. The variable nozzle of claim 1, wherein the locating members and locating grooves are non-uniformly spaced circumferentially.

* * * * *